United States Patent [19]

Tomita

[11] 4,225,399

[45] Sep. 30, 1980

[54] HIGH SPEED ALUMINUM ANODIZING

[76] Inventor: Setsuo Tomita, No. 1-2 Fukamizo-Ohzara, Kohda-gun, Aichi-ken, Japan

[21] Appl. No.: 33,173

[22] Filed: Apr. 25, 1979

[51] Int. Cl.[3] ..... C25D 11/06

[52] U.S. Cl. ..... 204/58; 204/274; 204/275

[58] Field of Search ..... 204/58, 274, 275, 276, 204/273

[56] References Cited

U.S. PATENT DOCUMENTS

| | | | |
|---|---|---|---|
| 3,532,607 | 10/1970 | Roberts | 204/58 X |
| 3,692,640 | 9/1972 | Hamabe et al. | 204/58 X |
| 4,133,725 | 1/1979 | Lerner et al. | 204/58 |
| 4,152,221 | 5/1979 | Schaedel | 204/58 X |

FOREIGN PATENT DOCUMENTS

| | | | |
|---|---|---|---|
| 51-29332 | 12/1976 | Japan | 204/58 |
| 1215314 | 12/1970 | United Kingdom | 204/58 |

OTHER PUBLICATIONS

S. Wernick et al., "The Surface Treatment & Finishing of Aluminum & Its Alloys", pp. 308-312 & 404-405, (1964).

*Primary Examiner*—G. L. Kaplan

*Attorney, Agent, or Firm*—Birch, Stewart, Kolasch & Birch

[57] ABSTRACT

Anodizing of aluminum or aluminum alloys at an exceptionally high film forming rate is conducted by the employment of a current density greater than 1.5 A/dm$^2$ and a concentration of sulfuric acid of from 20% to 30% by weight in an electrolyte solution bath, and by the use of a racking device and cooling device which is designed for said severe conditions of current density and sulfuric acid concentration. A careful selection and regulation of the anodizing temperature enables the option of forming a soft or hard oxide film of greater thickness than achieved heretofore. Bath temperatures of around 30° C. permit the formation of a soft oxide film, while bath temperatures of around 5° C. permit the formation of a hard oxide film.

10 Claims, 1 Drawing Figure

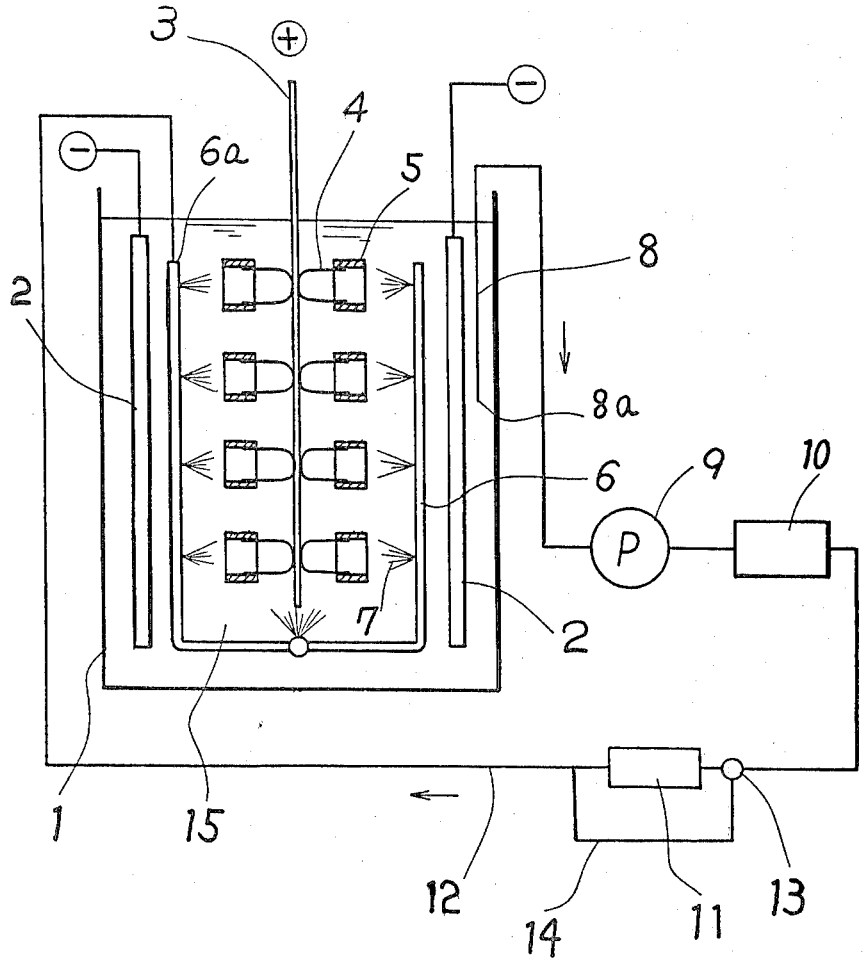
3
4
6a
5
8
2
8a
6
9
10
P
7
2
1
15
12
14
11
13

HIGH SPEED ALUMINUM ANODIZING

BACKGROUND OF THE INVENTION

1. Field of the Invention

The present invention generally relates to anodizing of aluminum or aluminum alloys and is particularly concerned with a process for forming oxide films of high durability over the surface of aluminum at a high anodizing rate.

2. Description of the Prior Art

In the anodizing of aluminum, it is customary to hang the articles to be treated on racking devices made of aluminum in order to soak them in a solution containing about 15% of sulfuric acid. In such a method, the film of $Al_2O_3$ formed over the surface of the aluminum by anodizing at a current density of about 1 A/dm$^2$ while keeping the bath temperature at about 20°±2° C. for about 60 minutes has a thickness of about 15μ. The rate of film formation is about 0.25μ/min. However, such a method hardly yields a film having a thickness of more than 20μ, while thicknesses of more than 20μ are quite advantageous and desired in order to enhance the rust-resistant property of the anodized film against the increasing air pollution problems of the present day. Therefore, it is clear that the conventional methods of the prior art are not suited for the anodizing operations of the future.

Although an increase in the current density may result in a concomitant increase in the rate of film formation in view of the common knowledge in the field of electrochemistry, it inevitably entails a proportionate decrease in the amount (number of units) of articles which can be treated in one batch with a power source of the same capacity and an increase in the heat generated in accordance with Joule's law which in turn means a requirement for special apparatus for cooling. Local and uneven high temperatures which may cause "burning" or scorching should particularly be avoided.

Even though the disadvantages concerning the limited amount of articles to be treated and special cooling problems might be tolerated, sparking which may cause said burning problems should at least be avoided. However, the articles to be treated will inevitably spark above a certain point of critical voltage when the bath voltage rises in view of the increasing current density.

A rise in the bath temperature is the other measure for increasing the current density because it means a concurrent decrease in the electrical resistivity of the electrolyte solution. However, this measure has an obvious limitation (20° C. at the most in the conventional operation) because it entails an increase in the rate of dissolution of the base or substrate metal into the solution, thereby reducing the thickness of the formed oxide film which also may become coarse and excessively porous at higher temperatures.

As previously described, the factors involved in and dominating the film forming rate are so interwoven with each other that a theoretical derivation of the desired conditions is very difficult if not impossible and an empirical mode of thinking has prevailed in most cases.

The above scrutiny with respect to the forming conditions of conventional soft anodized films may likewise be applied to those of hard anodized films. The "Tomaschov" method and the "Martin" method have hitherto been considered to be the most advanced methods for the formation of hard films. In the Tomaschov method, a 20% sulfuric acid bath is maintained at 2°±1° C. to perform the anodizing operation under the conditions of a current density of 2–5 A/dm$^2$ obtained by a terminal voltage of 23–120 V for 4 hours. The thickness of the formed film is about 200μ, wherein the rate of film formation is about 0.83μ/min. In the Martin method, an anodizing operation under the conditions of a 15% sulfuric acid concentration, a bath temperature of 0° C. and a current density of 2–2.5 A/dm$^2$ by means of a terminal voltage of 25–60 V for 40 minutes gives a film having a thickness of 25μ, wherein the rate of film formation is about 0.64μ/min. Either one of these methods is very difficult to perform in a routine operation as compared with a conventional hard film anodization, because of the need for a means for maintaining a very low temperature in the stated very narrow range.

As a result of a systematic investigation on various factors which may influence the film forming rate, the present inventor has found that although the prime importance must be placed on the increase in the current density, a sufficient consideration should also be extended to the material of the racking device which holds the articles to be treated on the anode, and to the cooling of the electrolyte solution to prevent the disadvantages attributable to the poor conducting property and to the heat generated in compliance with Joule's law, sparking problems and the like.

Cooling of the electrolyte solution by agitation with a mechanical stirrer or bubbling air, which is customary for keeping the bath temperature constant and uniform, has been found to be unsatisfactory because neither one of these methods is effective for preventing convection which might form graduated layers of liquids having different temperatures which tend to cause local heating.

SUMMARY OF THE INVENTION

According to the present invention, there is provided a method for anodizing aluminum or aluminum alloys in an electrolyte solution containing sulfuric acid in a concentration ranging from 20 to 30% at a substantially constant and uniform bath temperature and a current density in excess of 1.5 A/dm$^2$. The bath temperature should be maintained at 30°±2° C. if a soft (stainable) film is desired, whereas it should be maintained at 5°±2° C. if a hard film is desired. Thus, the present inventor has found that the temperature range for anodizing at a high film forming rate is limited to a relatively narrow range which may be expressed as about 30° C. for obtaining a soft film and about 5° C. for obtaining a hard film.

If the temperature rises above 30° C., not only will the film forming rate be decreased, but also a "powdering" phenomenon due to re-dissolving of the base or substrate metal or the once formed film layer into the electrolyte solution will occur. This happens because the film forming rate itself increases with the rise in the temperature, but the rate of dissolution also increases therewith.

On the other hand, when the temperature falls below the stated lower limit, the rate of film formation will increase but the formed film will become too dense and deepened in color, either of which is not desirable. In particular, the poor stainability of the film formed at a low temperature remarkably limits the use of the product covered with such a film.

The concentration of sulfuric acid in the electrolyte solution is also very important. An increase in its concentration beyond the upper limit of 30% will make the operation unstable and incapable of obtaining the desired film. A concentration under 20% will require a higher bath (terminal) voltage which entails a costly operation and makes the formed film too dense for the desired porosity.

With such a high sulfuric acid concentration, it is essential to limit the time during which the articles to be treated are soaked in the solution to as short as possible and therefore to employ a current density in excess of 1.5 $A/dm^2$. Below this lower limit, the result obtained by anodizing is not superior to the conventional methods.

In order to perform a stable operation in accordance with the present invention, it is also important to pay considerable attention to the material used for constructing the racking devices which hold the articles to be treated on the anode and which are to conduct the current effectively. The requirements for this material are sufficient electric conductivity and resistivity against sulfuric acid. Although the conventional racking devices made of aluminum are inexpensive and readily available, they usually require an additional operation of washing with caustic alkali solution to strip off the oxide film formed on the surface thereof for every anodizing operation. In addition to this, other problems may occur, such as a sudden increase in electric resistance during the progress of film formation and occasional sparking because of the tendency to form an oxide film at the contact points between the racking device and the articles to be treated on the anode.

Contrary to this, the employment of a corrosion-resistant conductor material such as titanium avoids such problems, such as those attributable to poor contact, and permits sufficiently stable conditions for the anodizing operation itself. Suitable materials for such corrosion-resistant racking devices may be exemplified as titanium, zirconium, niobium and the like. Among these, titanium has been found to be the most preferred from the economical point of view.

Since titanium is scarcely affected by the anodizing operation, occasional washing with hydrofluoric acid (nitric acid may optionally be added) is sufficient for maintaining the conductivity of the surface. However, since the relative conductivity of titanium is far smaller than that of aluminum, the use of thicker components or those made of, for example, titanium-clad copper or aluminum is preferred.

As previously described, sufficient cooling is needed in order to maintain the bath temperature constant and uniform for the successful performance of the method of the present invention. Stirring of the electrolyte solution by means of a mechanical agitator (propeller) or the bubbling of air is customarily employed but these techniques are very likely to cause a convection, which means the formation of graduated layers of solutions of different temperatures.

A modification of the air injection system which includes the forced circulation of air through the wall of a porous china cylinder for letting the air into the solution as minute bubbles requires an ingenious contrivance for the removal of heat from the circulating air, because the temperature of the air rises in the blower through which it is supplied after being subjected to a violent compression. In addition to this problem, it has been found that such a system is not suited for the successful performance of the present invention from the economical point of view. The existence of minute air bubbles in the electrolyte solution may be considered to be an inherent disadvantage because it increases the apparent volume of the solution and its specific electric resistance. This in turn means a need for a bath of larger dimensions and for a higher terminal voltage than those required if the solution contains no such minute air bubbles.

DESCRIPTION OF THE PREFERRED EMBODIMENT

The present inventor has found that an improved system which includes the use of a water jet for stirring the solution to produce a uniform turbulent flow of the solution throughout the bath which impinges the articles to be treated directly at high speed is superior to the air injection method, which entails minute air bubbles, and is the most suitable for the performance of the method of the present invention.

The present invention is further illustrated in the attached drawing which shows an embodiment of a system suitable for performing the anodizing method of the invention.

In an electrolytic bath 1 made of an insulator, for instance, a non-plasticized polyvinyl chloride filled with an electrolyte 15, a pair of graphite cathodes 2, 2 and an anode 3 made of titanium are installed. A plurality of racking devices 4, 4 are welded to the anode. A U-shaped spouting pipe 6 also made of non-plasticized polyvinyl chloride and having a multiplicity of spouting outlets or orifices 7, 7 directed to the anode, and therefore to the articles to be treated, is also provided in the bath. This pipe is shaped to effectively enclose the anode.

On one end **6*a* of the pipe 6, there is a junction with the system or connection pipeline 12. A suction pipe 8 having a suction inlet 8*a* is provided at one side of the bath 1 and is connected to the pipeline 12. This pipeline forms a closed circuit together with the bath 1, an acid resistant pump 9, a filter 10 and a heat-exchanger 11. A by-pass pipe 14 which is parallel with the heat-exchanger 11 and branched at a three-way valve 13 is provided to enable switching of the current of the electrolyte solution 15 to pass the same directly to the pipe 6 by keeping the current clear from the exchanger 11** when neither of the forced cooling or heating operations is required.

When an anodizing operation is performed in an apparatus constructed in accordance with the system illustrated in the drawing, the fluctuation in the bath temperature can be minimized effectively because the articles disposed on the racking devices 4,4 to be treated are in constant exposure to the jets from the outlets 7,7.

If the three-way valve 13 is designed to be electromagnetically operable and associated with a thermosensing device in the bath, it is very easy to control the temperature without necessitating any watching operation.

The described system is found to be greatly superior to any conventional apparatus in the following points:

(1) Ease of controlling the bath temperature, (2) Improved uniformity of the controlled temperature, (3) Compact dimension of the bath due to the suppressed apparent volume of the electrolyte solution which contains no bubbles, and (4) Clean and sanitary operation which is made possible by avoiding the unnecessary splashing of liquid entrained with the evolving air bubbles when an air injection system is employed.

As previously described, the high rate of surface film formation is the prime advantage of the present invention. Another advantage of the present invention constitutes the option to form either the hard or the soft film utilizing an electrolyte solution having the same ingredients from the point of view of its preparation and replenishment.

The film forming rates obtained in an anodizing operation performed on an aluminum plate (purity, 99.5%, 2S; 1t×300×400 mm) under the conditions of; sulfuric acid concentration, 30% , initial terminal voltage, 10–12 V and bath temperatures, 30°±2° C. and 5°±2° C., are about 1μ/min. at 3 A/dm$^2$ and about 2μ/min. at 5 A/dm$^2$, respectively. These rates are approximately twice those of the conventional method.

The hardness (Vickers, 50 g) of the anodized film obtained at 5°±2° C. ranges from 350 to 500, which is comparable to that obtained by the conventional method.

The following Examples are given merely as being illustrative of the present invention. Unless otherwise noted, the percentages therein and throughout the application are by weight.

EXAMPLES OF THE INVENTION

The conditions employed in anodizing operations performed for illustration of the advantages of the present invention, and the results obtained thereby are summarized in the following Tables, wherein an aqueous sulfuric acid (30%) solution is used as the electrolyte for anodizing specimens of 2S metal of 1t×300×400 mm.

Table 1

| Soft film (Temp., 30° ± 2° C.) | | | | |
|---|---|---|---|---|
| Current Density (A/dm$^2$) | Time (min.) | Thickness (μ) | Color and Tone | Hardness (Hv) |
| 3 | 15 | 15 | Silver-white | 220–300 |
| 5 | 15 | 33 | Silver-white | 220–300 |

Table 2

| Hard film (Temp., 5° ± 2° C.) | | | | |
|---|---|---|---|---|
| Current Density (A/dm$^2$) | Time (min.) | Thickness (μ) | Color and Tone | Hardness (Hv) |
| 3 | 30 | 30 | Thin greyish yellow | 330 |
| 3 | 60 | 59 | Greyish yellow | 400 |
| 3 | 90 | 88 | Deep greyish yellow | 450 |
| 5 | 30 | 62 | Deep greyish yellow | 420 |
| 5 | 60 | 118 | Deep greyish yellow | 480 |
| 5 | 90 | 178 | Black | 520 |

The invention being thus described, it will be obvious that the same may be varied in many ways. Such variations are not to be regarded as a departure from the spirit and scope of the invention, and all such modifications are intended to be included within the scope of the following claims.

What is claimed is:

1. A method for anodizing the surface of an aluminum or aluminum alloy substrate which comprises conducting the anodizing in an aqueous electrolyte bath containing sulfuric acid in a concentration of from 20% to 30% by weight at a substantially constant and uniform bath temperature and at a current density in excess of 1.5 A/dm$^2$, the anodizing being conducted with a forced circulation of electrolyte which directly impinges the article to be treated after being cooled sufficiently to maintain a constant and uniform bath temperature.

2. A method as claimed in claim 1, wherein the temperature is maintained at 30°±2° C., thereby resulting in the formation of a soft oxide film.

3. A method as claimed in claim 1, wherein the temperature is maintained at 5°±2° C., thereby resulting in the formation of a hard oxide film.

4. A method as claimed in claims 1, 2 or 3, wherein the anodizing is conducted with the use of a racking device made of a corrosion-resistant material.

5. A method as claimed in claim 4, wherein the corrosion-resistant material is selected from the group consisting of titanium, zirconium, and niobium.

6. A method as claimed in claim 4, wherein the racking device is made of titanium-clad copper or aluminum.

7. A method as claimed in claims 1, 2 or 3, wherein the forced circulation of the electrolyte is effected by means of a heat exchange system located outside of the electrolyte bath.

8. A method as claimed in claims 1, 2 or 3, wherein the current density ranges from 3 to 5 A/dm$^2$.

9. A method for anodizing the surface of an aluminum or aluminum alloy substrate which comprises conducting the anodizing in an aqueous electrolyte bath containing sulfuric acid in a concentration of from 20% to 30% by weight at a substantially constant and uniform bath temperature of 30°±2° C. for the formation of a soft oxide film or 5°±2° C. for the formation of a hard oxide film and at a current density of from 3 to 5 A/dm$^2$, the anodizing being conducted with a forced circulation of electrolyte which directly impinges the article to be treated after being cooled sufficiently to maintain a constant and uniform bath temperature and with the use of a racking device made of a corrosion-resistant material.

10. A method as claimed in claim 9, wherein the corrosion-resistant material is selected from the group consisting of titanium, zirconium and niobium.

* * * * *